US011975380B2

(12) United States Patent
Brochman

(10) Patent No.: US 11,975,380 B2
(45) Date of Patent: May 7, 2024

(54) TUBING BENDER

(71) Applicant: BROCHMAN INNOVATIONS, LLC, White Bear Lake, MN (US)

(72) Inventor: Todd Brochman, White Bear Lake, MN (US)

(73) Assignee: Brochman Innovations, LLC, White Bear Lake, MN (US)

( * ) Notice: Subject to any disclaimer, the term of this patent is extended or adjusted under 35 U.S.C. 154(b) by 174 days.

(21) Appl. No.: 17/292,193

(22) PCT Filed: Nov. 5, 2019

(86) PCT No.: PCT/US2019/059759

§ 371 (c)(1),
(2) Date: May 7, 2021

(87) PCT Pub. No.: WO2020/097007

PCT Pub. Date: May 14, 2020

(65) Prior Publication Data

US 2021/0387243 A1 Dec. 16, 2021

Related U.S. Application Data

(63) Continuation-in-part of application No. 16/247,211, filed on Jan. 14, 2019, now Pat. No. 10,441,984.
(Continued)

(51) Int. Cl.
*B21D 7/06* (2006.01)

(52) U.S. Cl.
CPC ..... *B21D 7/06* (2013.01)

(58) Field of Classification Search
CPC . B21D 7/02; B21D 7/022; B21D 7/06; B21D 7/12; B21D 7/024; B21D 7/08
See application file for complete search history.

(56) References Cited

U.S. PATENT DOCUMENTS 5,022,249 A 6/1991 Caporusso et al.
5,931,039 A 8/1999 Yoshimizu et al.
(Continued)

FOREIGN PATENT DOCUMENTS

DE 69407444 T2 8/1998
DE 60007262 T2 9/2004
(Continued)

OTHER PUBLICATIONS

PCT International Search Report for PCT/US2019/059759, mailed Mar. 24, 2020, 3 pages.
(Continued)

*Primary Examiner* — Teresa M Ekiert
(74) *Attorney, Agent, or Firm* — Merchant & Gould P.C.

(57) ABSTRACT

A portable tubing bender configured to automatically bend a portion of tubing according to a defined set of bend specifications, including a desired number of bends and a desired angle for each bend. The portable tubing bender including a driver configured to rotate a driven shaft and a first rotational output, a reductive gear set operably coupling the driven shaft to an output shaft, a bender shoe couplable to the output shaft, the bender shoe defining an arcuate channel configured to receive tubing during bending operations, and an automatic feed mechanism configured to advance the tubing relative to the bender shoe from an initial position to a bend position.

21 Claims, 17 Drawing Sheets

Related U.S. Application Data

(60) Provisional application No. 62/757,936, filed on Nov. 9, 2018.

(56) References Cited

U.S. PATENT DOCUMENTS

| | | | | |
|---|---|---|---|---|
| 6,026,668 | A | 2/2000 | Oda et al. | |
| 7,900,495 | B2 | 3/2011 | Latoria | |
| 9,718,108 | B2 | 8/2017 | Latoria | |
| 9,849,494 | B2 * | 12/2017 | Plummer | B21D 7/024 |
| 2008/0190164 | A1 | 8/2008 | Boon | |
| 2009/0188291 | A1 | 7/2009 | Itrich et al. | |
| 2018/0126436 | A1 | 5/2018 | Lan | |

FOREIGN PATENT DOCUMENTS

| | | | |
|---|---|---|---|
| GB | 2228221 | A1 | 8/1990 |
| JP | 51459375 | A | 12/1979 |

OTHER PUBLICATIONS

PCT Written Opinion of the ISA for PCT/US2019/059759, mailed Mar. 24, 2020, 5 pages.
https://www.youtube.com/watch?v=5csGGM6B9vs Oct. 31, 2014 (Oct. 31, 2014) The whole document.

* cited by examiner

TUBING BENDER

RELATED APPLICATION INFORMATION

This application is a National Phase entry of PCT Application No. PCT/US2019/059759, filed Nov. 5, 2019, which claims the benefit of U.S. Provisional Application No. 62/757,936, filed Nov. 9, 2018 and U.S. patent application Ser. No. 16/247,211, filed Jan. 14, 2019, the disclosures of which are fully incorporated herein by reference in their entirety.

TECHNICAL FIELD

The present disclosure relates generally to conduit benders, and more particularly to powered portable conduit benders.

BACKGROUND

Electrical conduit is a thin-walled tubing used to protect and route electrical wiring in a building or structure. Electrical conduit, often in the form of Electrical Metallic Tubing (EMT), is constructed of straight elongated sections of corrosion resistant galvanized steel of about 3 meters (10 feet) in length, with a diameter of between about 1.2 cm (½ inch) and about 10 cm (4 inches). For example, EMT with standard trade size designations from 1.2 cm (½ inch) to 10 cm (4 inches) is commonly installed by electricians at electrical equipment installation sites in compliance with the U.S. National Electric Code (NEC) and other building codes.

Prior to installation, it is often necessary to bend the conduit. This can be accomplished with a manually operated tool known as a conduit bender, which provides a desired bend in the conduit without collapsing the conduit walls. A typical conduit bender includes a handle and a head. The head is generally a one-piece construction, including an arcuate shoe with a lateral concave channel for supporting the conduit. A hook is generally formed into the head proximate to one end of the channel for engaging a portion of conduit received in the channel. The handle, which is generally about 1 meter (3 feet) long, is secured to the head and is generally positioned in a radial line relative to the arcuate shoe. Such manually operated conduit benders are commonly produced by companies such as BENFIELD ELECTRIC CO., GARDNER BENDER, GREENLEE TOOLS, IDEAL INDUSTRIES, KLEIN TOOLS, and NSI INDUSTRIES, among others.

To bend the conduit, a length of conduit is positioned on a supporting surface, such as the ground, with a portion of the conduit positioned within the channel of the arcuate shoe, such that the hook of the conduit bender engages the conduit. The handle is then forced to roll the shoe onto the conduit, thereby bending the conduit to fill in the arcuate channel. Accordingly, the use of a manually operated conduit bender requires a stable work surface, as well as space sufficient to manipulate the handle relative to the conduit. For larger size conduit, such as EMT with a designated standard size of about 2.6 cm (1 inch) or greater, the bending may be assisted by an electric, hydraulic or pneumatic motor. Various heavy-duty wheeled or bench mounted benders are produced by companies such as GREENLEE TOOLS, among others.

Recent advances in conduit bending have seen an introduction of portable powered conduit benders. Various examples of such powered benders are disclosed in U.S. Pat. Nos. 7,900,495; 9,718,108 and U.S. Patent Publication No. 2009/0188291, assigned to Husky Tools, Inc. Another example of a bending apparatus is disclosed in U.S. Patent Publication No. 2008/0190164.

Installations frequently require the conduit to be routed along the ceiling or parts of a building structure that are normally out of reach when standing on the ground. In such instances, it is common to utilize a lift, frequently referred to as a "cherry picker," to safely access the intended conduit route. However, given the limited size of the platform or basket of most lifts, and the lack of a stable horizontal work surface, it is difficult to operate a manual conduit bender while using the lift. Accordingly, most electricians bend conduit on the ground before loading the bent conduit onto the lift and ascending to the installation location. If it is determined that additional bending is required, the electrician may have to descend back to the ground to conduct additional bending. In some instances, multiple ascents and descents are required to complete the electrical routing, all of which can significantly add to the time and expense of the electrical conduit installation. Further, in some instances, the electrician may be working with multiple conduit diameters, each of which requires its own specific tool to complete the desired bends. The present disclosure addresses these concerns.

SUMMARY OF THE DISCLOSURE

Embodiments of the present disclosure provide a portable tubing bender configured to automatically bend a portion of tubing according to a defined set of bend specifications. The defined set of bend specifications may include all of the necessary bends at the appropriate angles to complete a desired layout of conduit within a given space. In one embodiment, a mobile computing device (e.g., a cellular telephone, tablet or portable computer) can be used as an aid in determining one or more dimensions of a space in which the conduit is to be installed. Thereafter, the mobile computing device can further be used to design a layout for the conduit, including defined bend specifications (e.g., a defined set of bend specifications for each portion of tubing). Thereafter, a programmable controller can utilize the defined bend specifications to drive an automatic feed mechanism and a bending driver that can bend each portion of tubing according to the defined bend specifications.

One embodiment of the present disclosure provides a portable tubing bender, including a driver, a reductive gear set, a bender shoe, and an automatic feed mechanism. The driver can be configured to rotate a driven shaft at a first rotational output. The reductive gear set can be operably and comparably coupled to the driven shaft and an output shaft and can be configured to reduce the first rotational output at the driven shaft to a second rotational output at the output shaft. The bender shoe can be coupleable to the output shaft, and can define an arcuate channel configured to receive tubing during bending operations. The automatic feed mechanism can be configured to advance the tubing relative to the bender shoe from an initial position to a bend position. In one embodiment, the automatic feed mechanism is further configured to rotate the tubing relative to the bender shoe.

In one embodiment, the automatic feed mechanism is in communication with a programmable controller configured to drive the automatic feed mechanism and driver according to defined tubing bend specifications. In one embodiment, the programmable controller is wirelessly coupleable to a mobile computing device. In one embodiment, the mobile computing device is at least one of a cellular telephone, tablet or portable computer. In one embodiment, the mobile computing device is configured to receive bend specifications for the tubing. In one embodiment, the bend specifications include a desired number of bends and a desired bend angle and spacing for each bend. In one embodiment, the mobile computing device is configured to aid in determining one or more dimensions of a space in which the tubing is to be installed.

In one embodiment, the driver is battery-powered. In one embodiment, the bender shoe is a combination bender shoe defining a plurality of arcuate channels shaped and sized to receive tubing of different diameters. In one embodiment, the arcuate channel of the bender shoe is configured to receive tubing having a diameter of between about 1.2 cm (½ inch) and about 10 cm (4 inches). In one embodiment, the arcuate channel of the tubing bender is configured to receive at least one of Electrical Metallic Tubing (EMT), Rigid Metal Conduit (RMC), Intermediate Metal Conduit (IMC), copper tubing, stainless steel tubing, tubing used for HVAC or refrigeration systems, tubing used in elevator systems, or other types of tubing or conduit.

Another embodiment of the present disclosure provides a portable hard case tubing bender, including a driver, a reductive gear set, a portable hard case housing, a bender shoe, and an automatic feed mechanism. The driver can be configured to drive a driven shaft at a first rotational output. The reductive gear set can operably couple the driven shaft to an output shaft, and can be configured to reduce the first rotational output at the driven shaft to a second rotational output at the output shaft. The portable hard case housing can define an interior cavity configured to house the reductive gear set, such that only a portion of the output shaft extends to an exterior of the housing. The bender shoe can be couplable to the output shaft. The automatic feed mechanism can be configured to advance tubing relative to the bender shoe from an initial position to a bend position. In one embodiment, the portable hard case housing can be configured to be operably coupled to a wheeled cart.

Yet another embodiment of the present disclosure provides a method of bending tubing, including: receiving bend specifications for a portion of tubing, the bend specifications including a desired number of bends and the desired angle of each bend on the portion of tubing; advancing the portion of tubing relative to a bender shoe from an initial position to a bend position; and driving the bender shoe to complete at least one bend according to the received bend specifications.

The summary above is not intended to describe each illustrated embodiment or every implementation of the present disclosure. The figures and the detailed description that follow more particularly exemplify these embodiments.

BRIEF DESCRIPTION OF THE DRAWINGS

The disclosure can be more completely understood in consideration of the following detailed description of various embodiments of the disclosure, in connection with the accompanying drawings, in which.

Figure 1:
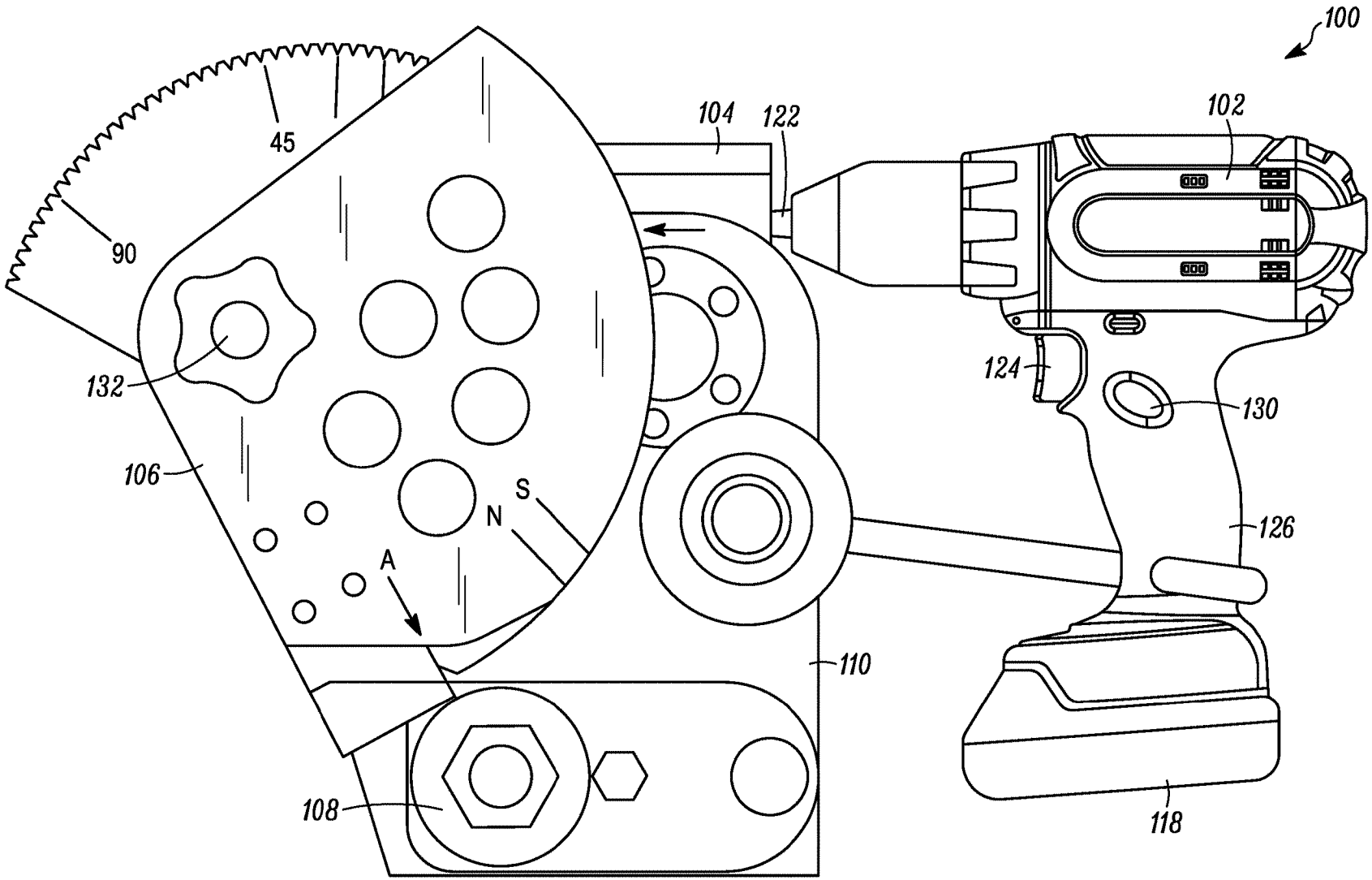
FIG. 1 is a left side profile view depicting a conduit bender, in accordance with an embodiment of the disclosure.

While embodiments of the disclosure are amenable to various modifications and alternative forms, specifics thereof shown by way of example in the drawings will be described in detail. It should be understood, however, that the intention is not to limit the disclosure to the particular embodiments described. On the contrary, the intention is to cover all modifications, equivalents, and alternatives falling within the spirit and scope of the subject matter as defined by the claims.

DETAILED DESCRIPTION

Referring to FIGS. 1-3B, a portable conduit bender 100, 100', 100" configured to enable a user to bend conduit in a confined area, is depicted in accordance with an embodiment of the disclosure. The conduit bender 100, 100', 100" can be configured to enable a user to bend tubing or conduit, such as Electrical Metallic Tubing (EMT), Rigid Metal Conduit (RMC), Intermediate Metal Conduit (IMC), PVC coated rigid metal conduit, copper tubing, aluminum tubing, tubing used for HVAC or refrigeration systems, tubing used in elevator systems, or other types of tubing or conduit, in a confined area, such as the platform of a lift or other limited workspace. The conduit bender 100, 100', 100" can be configured to bend tubing or conduit of a number of standard trade size designations (e.g., 0.6 cm (¼ inch), 1 cm (⅜ inch), 1.2 cm (½ inch), 1.9 cm (¾ inch), 2.5 cm (1 inch), 3.2 cm (1¼ inch), 3.8 cm (1½ inch), 5 cm (2 inch), 6.3 cm (2½ inch), 7.6 cm (3 inch), 8.9 cm (3½ inch), 10.2 cm (4 inch, etc.), or generally conduit having a diameter of between about 1 cm (⅜ inch) and about 10.2 cm (4 inches). The conduit bender 100, 100', 100" can be configured to bend the conduit through a range of angles between about 0° and about 180° over a time span of up to about 60 seconds, depending upon the bend angle desired.

With reference to FIG. 1, conduit benders 100, 100', 100" as disclosed herein can generally include a driver 102, a reductive gear set 104, one or more bender shoes 106, and an optional tubing guide or bearing wheel 108. As depicted in FIG. 1, in some embodiments, the driver 102 can be optionally coupled to a frame 110 of the conduit bender 100. For example, the driver 102 can be a portable, battery-powered device, such as a cordless drill, or the like. In embodiments, the driver 102 can be non-brand specific, such that any cordless drill with acceptable dimensions can be utilized as the driver 102. For example, the driver 102 can be a cordless drill produced by companies such as DEWALT, MILWAUKEE, MAKITA, BOSCH, or RYOBI, among others.

Figure 2A:
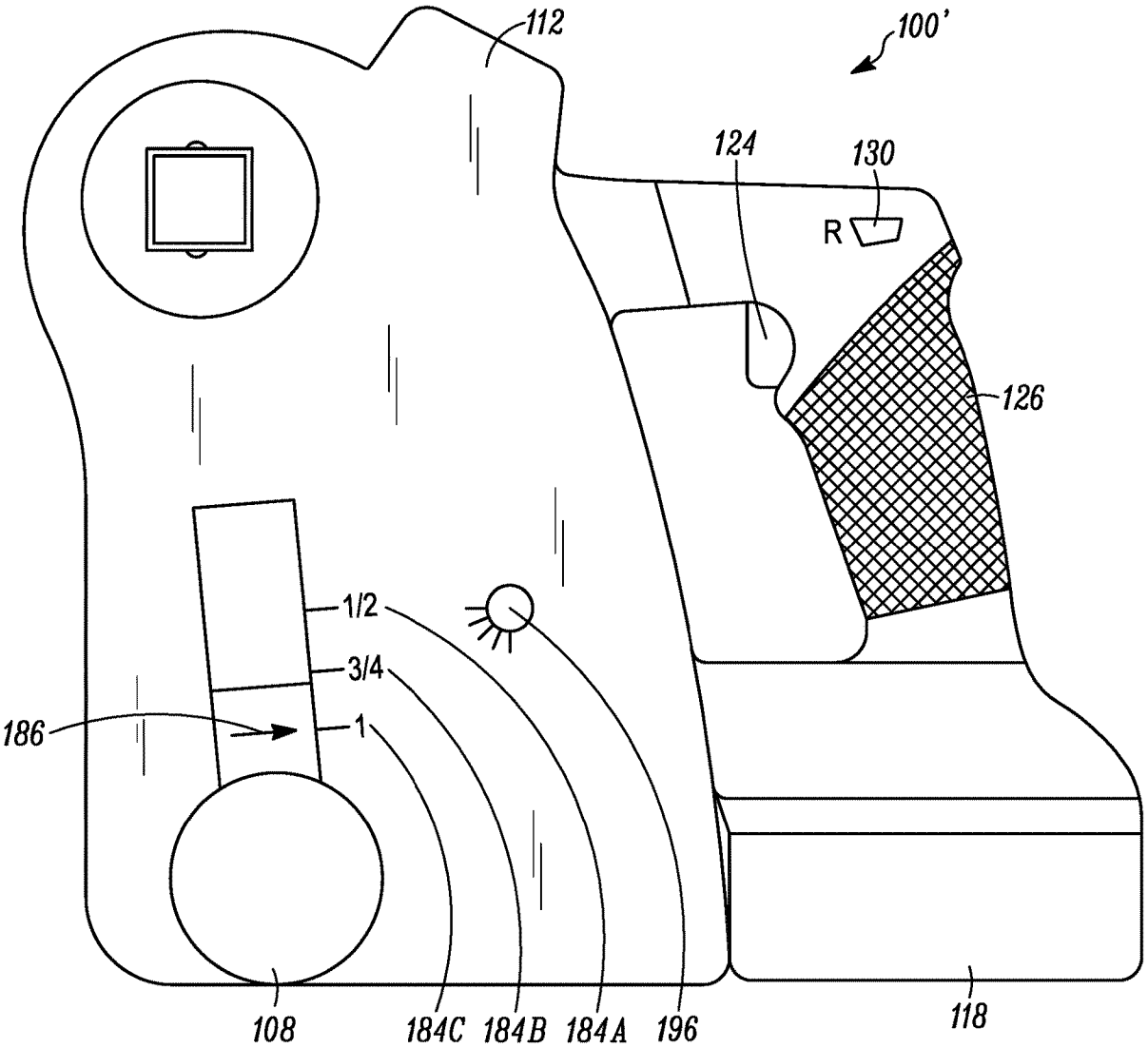
FIG. 2A is a left side profile view depicting a conduit bender in accordance with an embodiment of the disclosure.
Figure 2B:
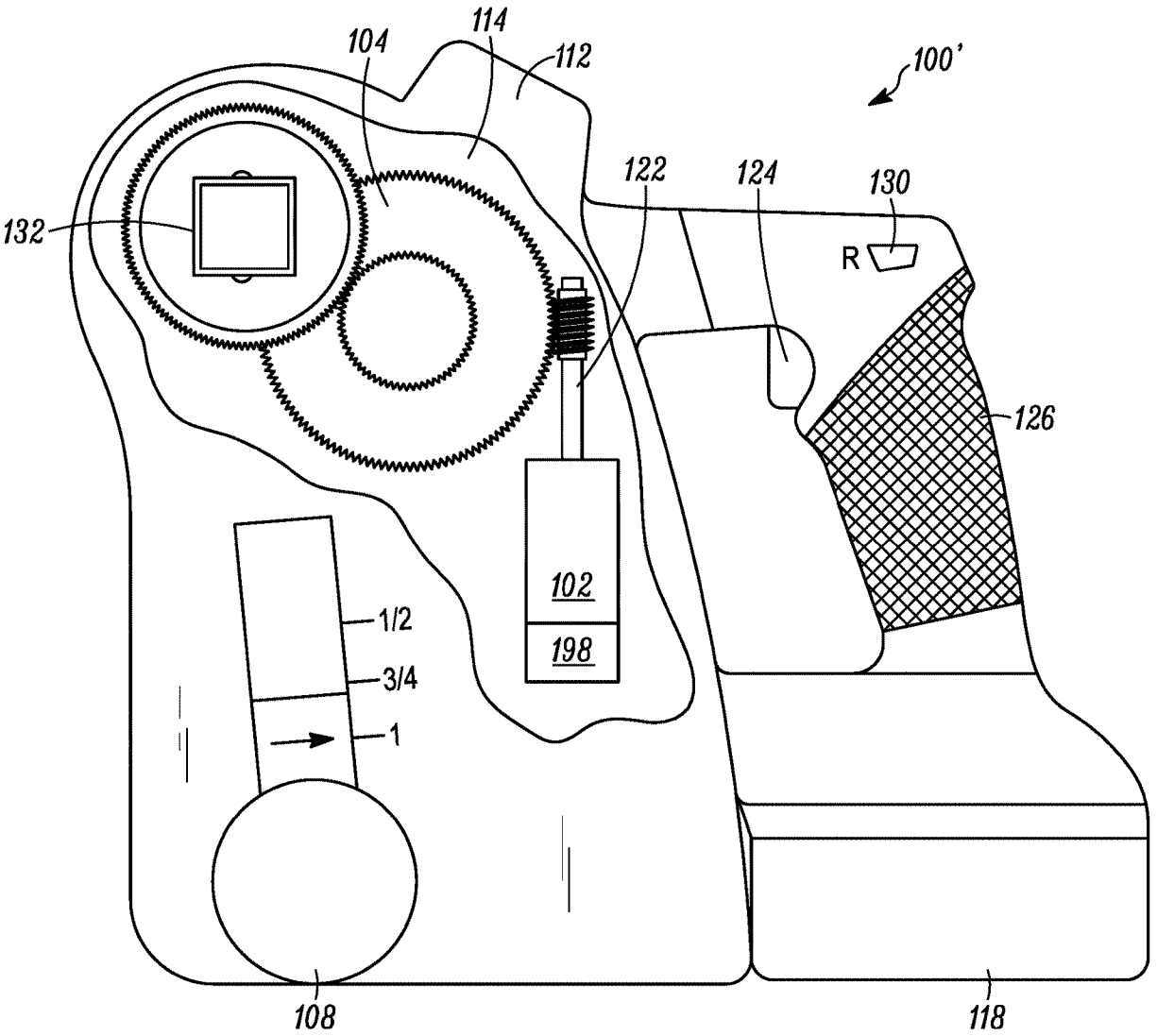
FIG. 2B is a partial cutaway left side profile view depicting the conduit bender of FIG. 2A.
Figure 2C:
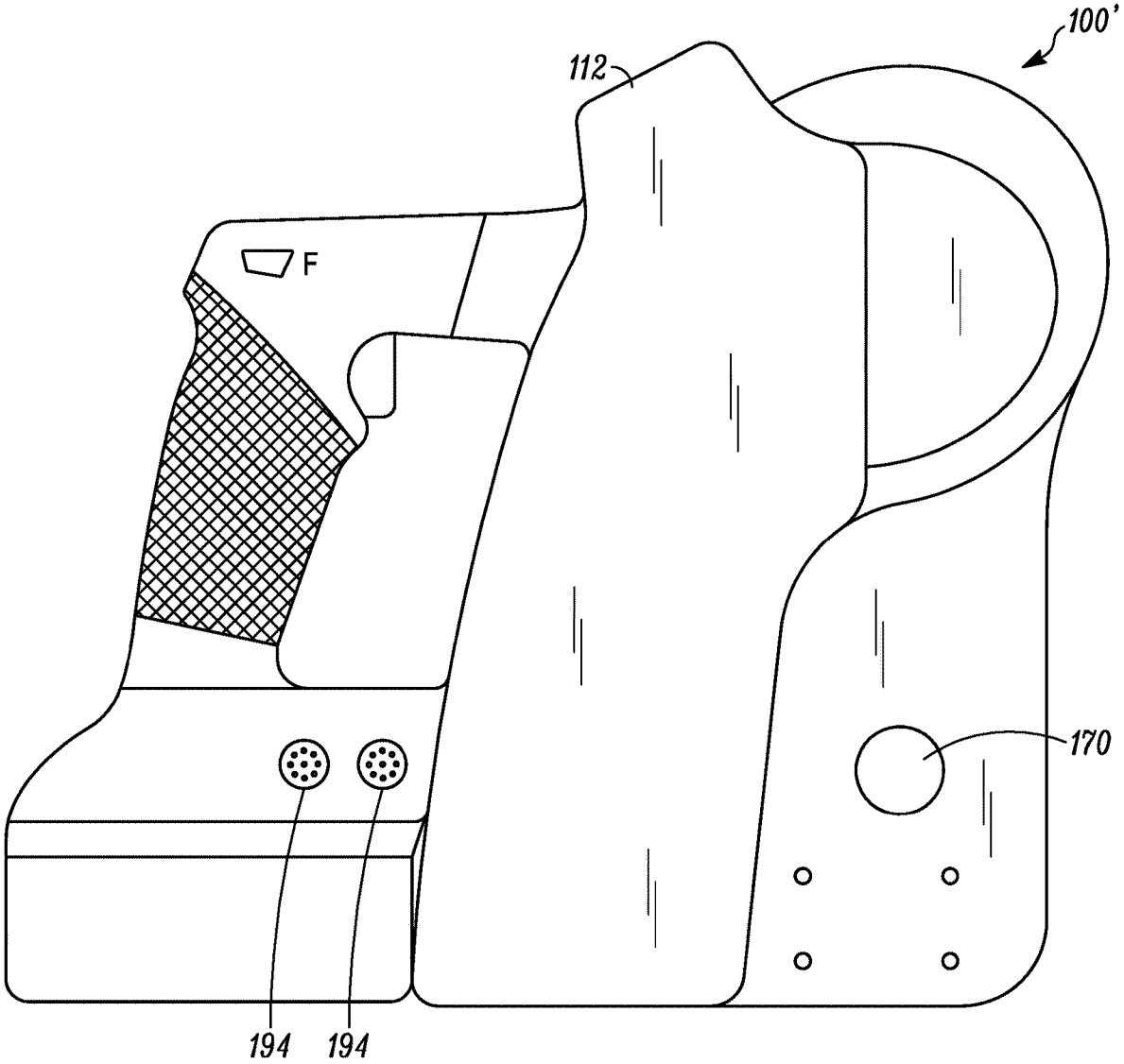
FIG. 2C is a right side profile view depicting the conduit bender of FIG. 2A.
Figure 2D:
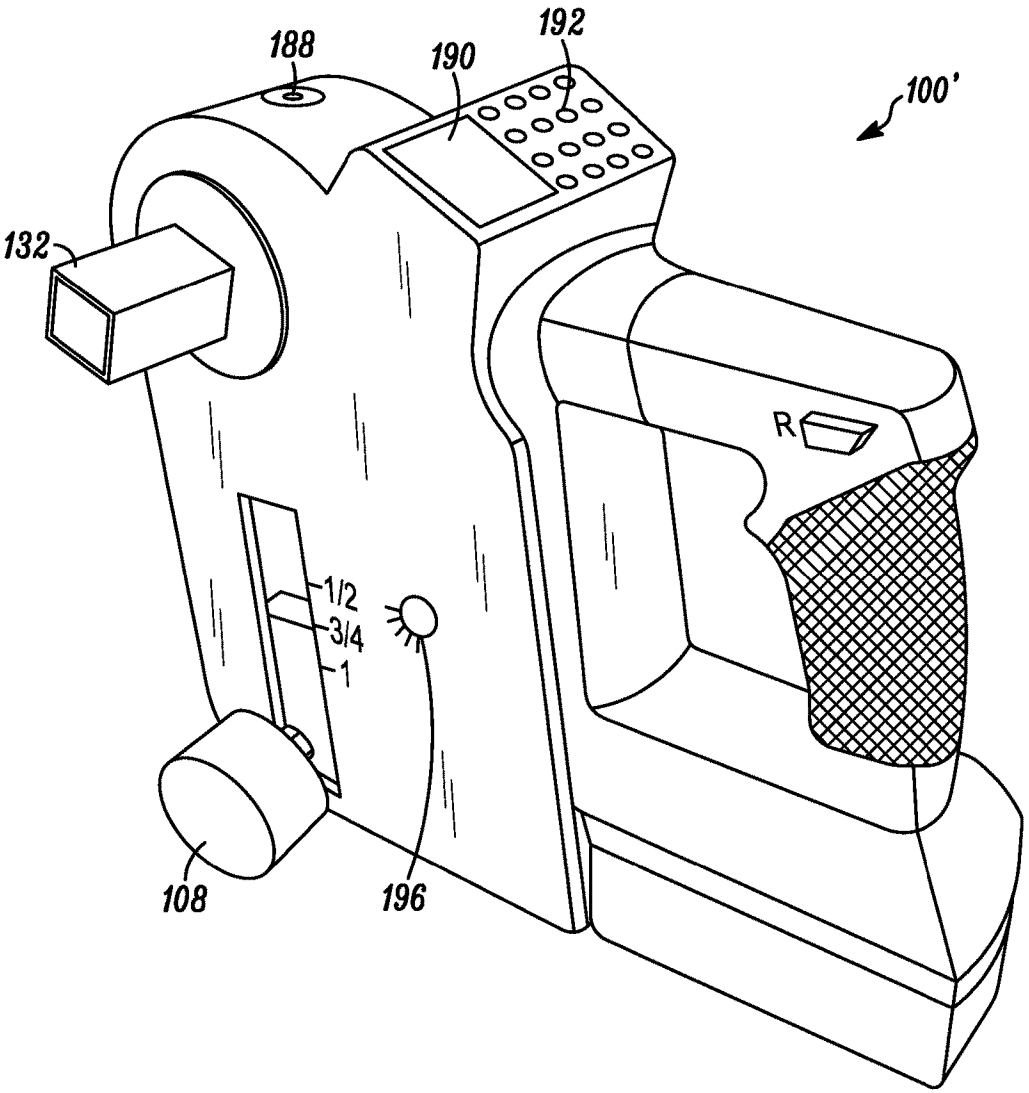
FIG. 2D is a perspective view depicting the conduit bender of FIG. 2A.
Figure 2E:
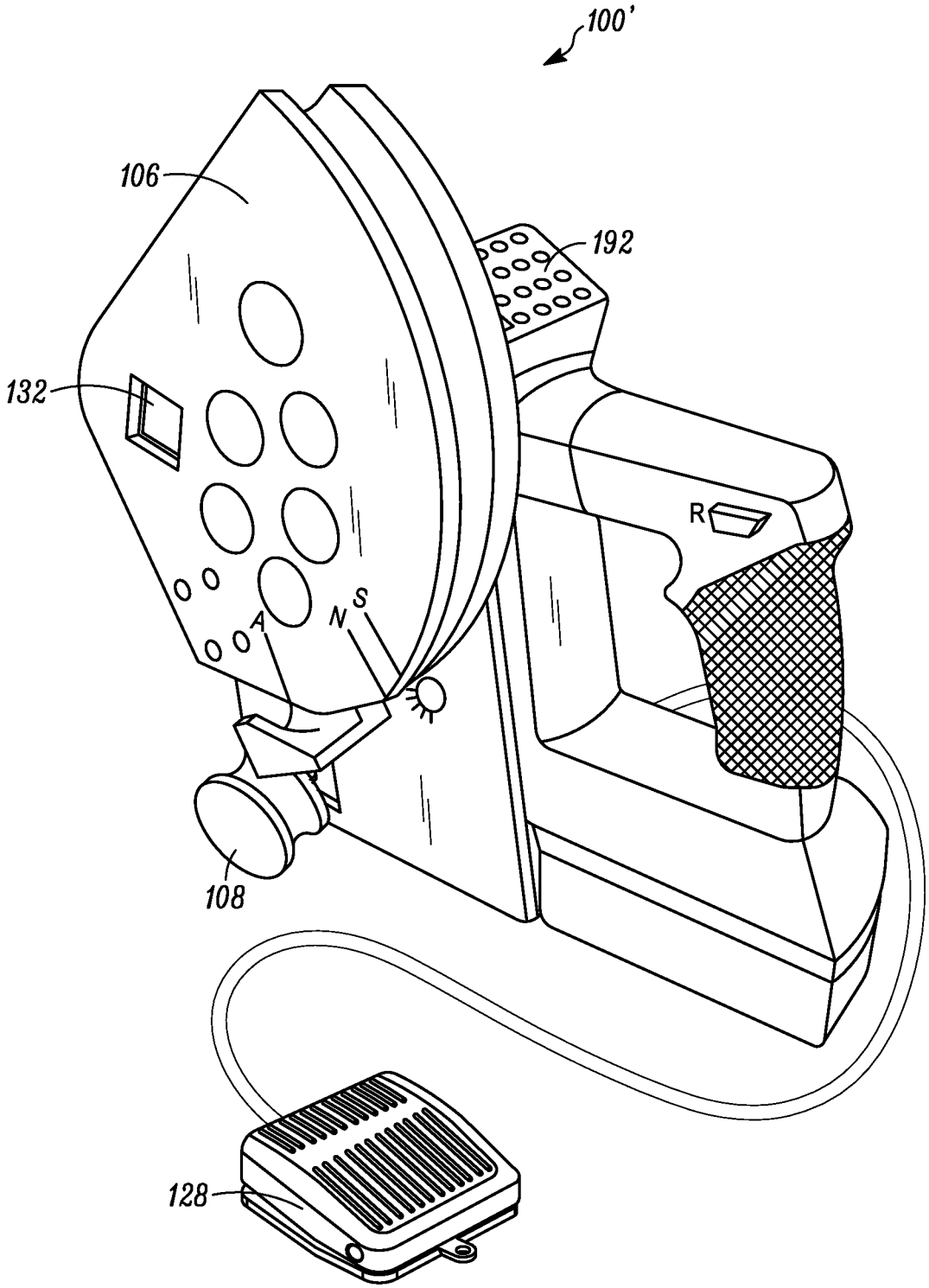
FIG. 2E is a perspective view depicting a conduit bender having a bender shoe and a remote user interface, in accordance with an embodiment of the disclosure.
Figure 3A:
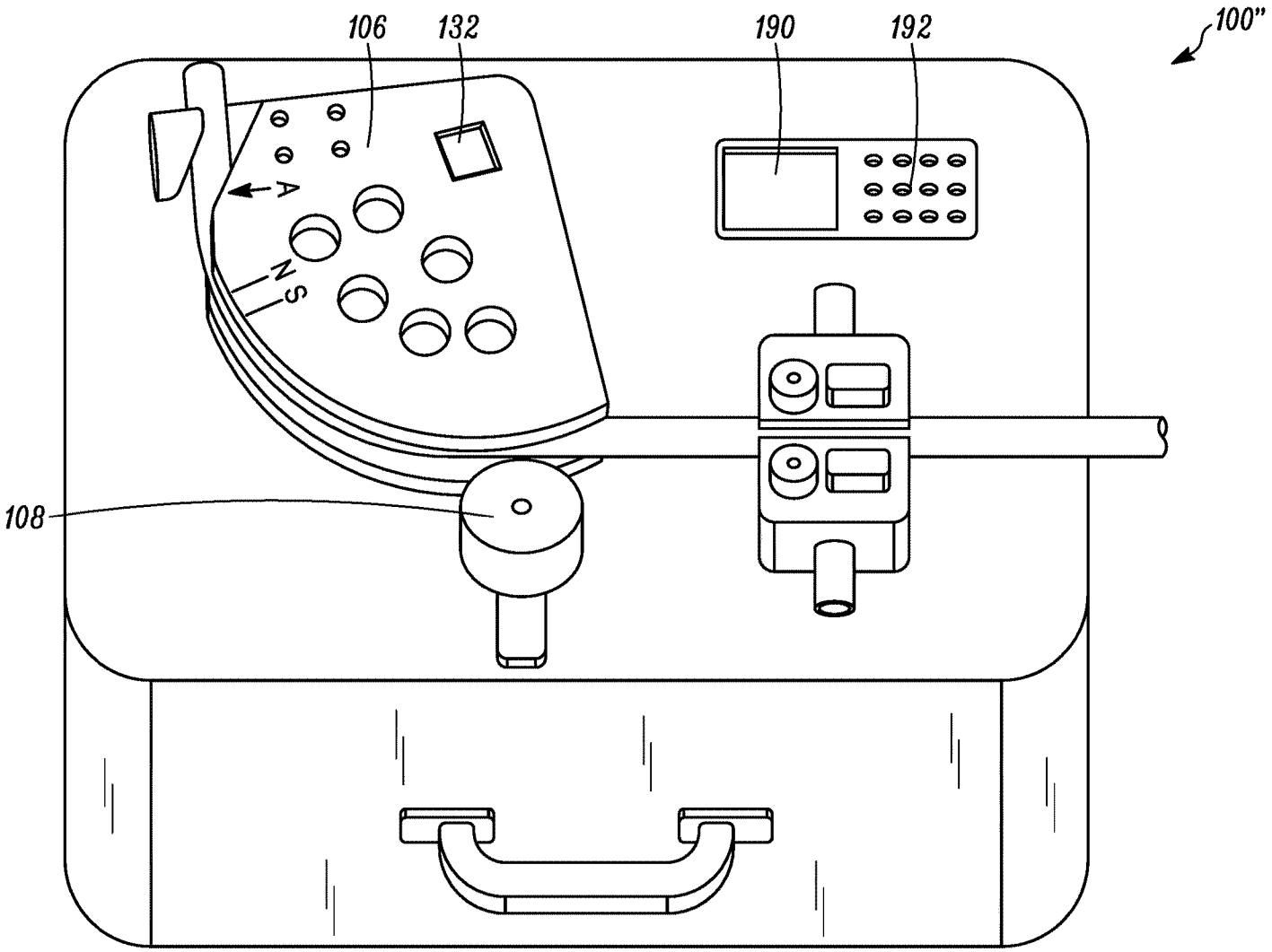
FIG. 3A is a perspective view depicting a conduit bender in accordance with an embodiment of the disclosure.
Figure 3B:
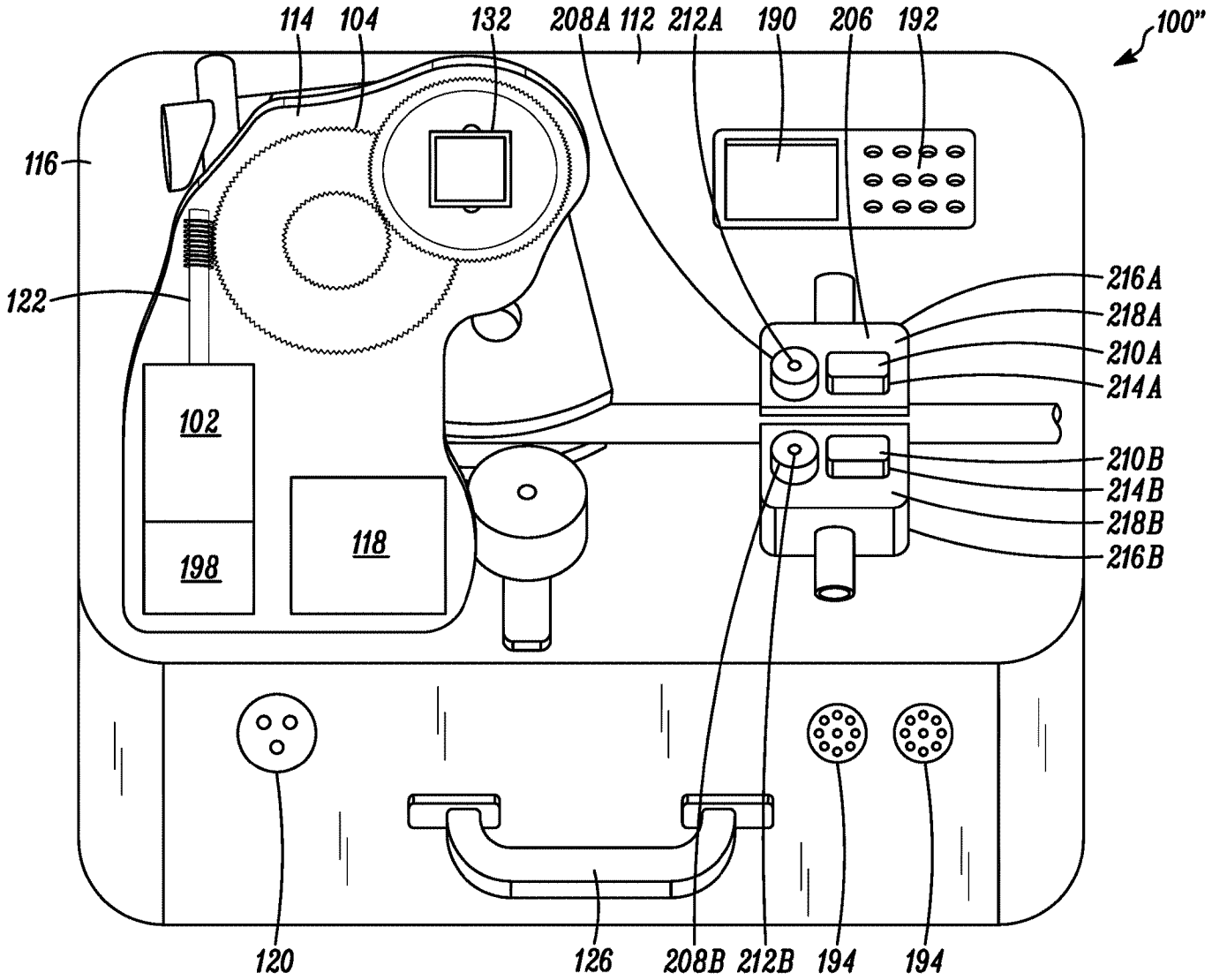
FIG. 3B is a partial cutaway left side profile view depicting the conduit bender of FIG. 3A.

Alternatively, as depicted in FIGS. 2A-E and 3A-B, in other embodiments, the driver 102 can be fixedly coupled to the conduit bender 100', 100". For example, the conduit bender 100', 100" can be self-contained, such that the driver 102 and at least a portion of a reductive gear set 104 resides within a housing 112, which can be constructed of a rigid or semi-rigid material, such as plastics, fiberglass, composites, or lightweight metals, such as aluminum or magnesium. For example, as depicted in FIGS. 2A-E, in one embodiment, the conduit bender 100' can be configured as a portable, hand-held device configured to enable a user to readily grip the conduit bender for increased maneuverability and ease in use. In another embodiment, as depicted in FIGS. 3A-B, the housing 112 of the conduit bender 100" can be configured as a hard case, which can be carried to and from a worksite.

With particular reference to FIGS. 2B and 3B, the housing 112 can define an interior cavity 114 configured to house at least a portion of the reductive gear set 104, such that only a portion of the reductive gear set 104 emerges from the interior cavity 114 to extend to an exterior surface 116 of the housing 112, thereby improving user safety by shielding drive system pinch points and rotating components which can bite the user or grab an article of clothing, as well as to extend the life of the conduit bender 100 by limiting exposure of the reductive gear set 104 and driver 102 to foreign articles, such as dust and debris.

With reference to FIGS. 1, 2B and 3B, in some embodiments, the driver 102 of the portable conduit bender 100, 100', 100" can be powered by a battery pack 118, which can be removable and rechargeable. In other embodiments, the battery pack 118 can remain fixed in position within the housing 112 while being recharged. For example, in one embodiment, the housing 112 can include an electrical outlet 120 (as depicted in FIG. 3B) configured to enable connection of the conduit bender 100" to an external electrical power source, such as a 120 or 240 VAC, or other direct or alternating current power source. In such embodiments, the driver 102 can be selectively powered by the battery pack 118 or the external power source via the outlet 120. In other embodiments, the driver 102 can be pneumatically or hydraulically operated.

With continued reference to FIGS. 1, 2B and 3B, the driver 102 can be configured to rotate a driven shaft 122 at a first rotational output. The driver 102 can be controlled via a plurality of inputs. For example, in one embodiment, the first rotational output can be started, stopped and otherwise controlled for variable speed, duration or both speed and duration via a trigger 124 (as depicted in FIGS. 1 and 2B) or other input, for example, mounted within a handgrip 126 of the driver 102, frame 110 or housing 112. In other embodiments, actuation of the driver 102 can be controlled via another user input 128, such as a foot switch (as depicted in FIG. 2E). Forward and reverse directional control of the first rotational output can be controlled via a forward and reverse switch 130 (as depicted in FIGS. 1 and 2A-B), which can optionally be mounted in proximity to the handgrip 126. In other embodiments, one or more of actuation, speed, duration, and directional control of the first rotational output can be controlled, at least in part, by a programmable controller (as discussed in greater detail below).

The reductive gear set 104 can be configured to operably couple the driven shaft 122 to an output shaft 132, thereby reducing the first rotational output of the driven shaft 122 to a second rotational output of the output shaft 132. The reductive gear set 104 can be made up of a plurality of different gearing types and configurations to achieve the desired reduction in RPM and corresponding increase in torque necessary to bend conduit. The reductive gear set 104 can be constructed of a high strength, rigid material, such as steel; although other materials, such as light weight, high-strength alloys (e.g., a magnesium or aluminum alloy) and composites are also contemplated.

Figure 4A:
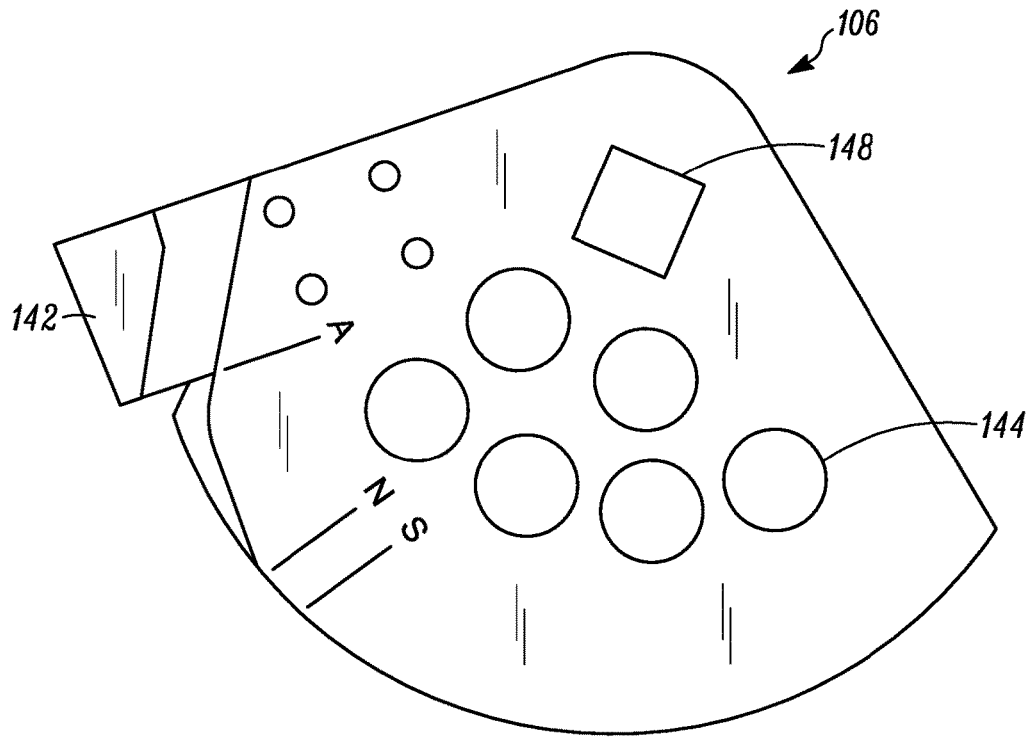
FIG. 4A is a front profile view depicting a bender shoe, in accordance with an embodiment of the disclosure.
Figure 4B:
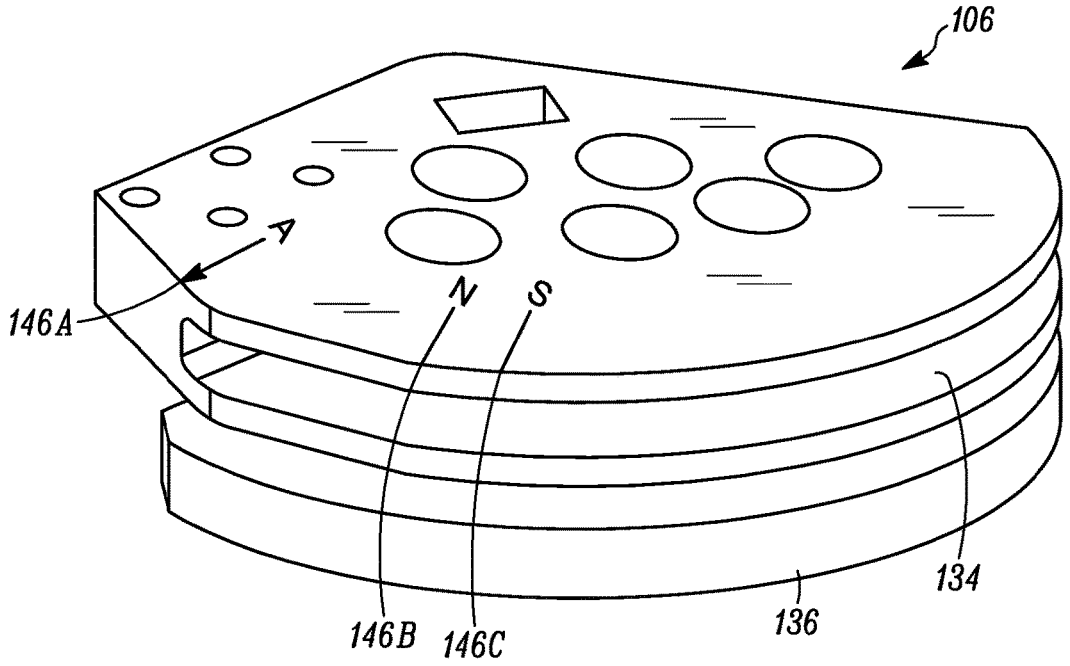
FIG. 4B is a perspective view depicting a bender shoe, in accordance with an embodiment of the disclosure.

One or more bender shoes 106 can be selectively coupled to the output shaft 132 to rotate across a range of motion necessary to complete desired conduit bends. Referring to FIGS. 4A-B, the bender shoe 106 can define an arcuate channel 134 along a peripheral edge 136 of the bender shoe 106, shaped and sized to receive a cross-section of conduit of a standard trade size. The arcuate channel 134 can define a convex arc corresponding to the NEC approved a minimum bend radius for conduit of a standard trade size. Accordingly, in one embodiment, the size of the bender shoe 106 can be specific to the size of the conduit to be bent. Different sized bender shoes 106 can be provided for different sized conduit. For example, a first bender shoe can be provided for about 3.8 cm (1½ inch) EMT, an optional second bender shoe can be provided for three-quarter inch EMT, and optional third and fourth bender shoes can be provided for 1 and about 3.2 cm (1¼ inch) EMT. It is also contemplated that the bender shoe 106 can be configured to bend other types of materials, such as Rigid Metal Conduit (RMC), Intermediate Metal Conduit (IMC), copper tubing, tubing used for HVAC or refrigeration systems, tubing used in elevator systems, and other types of tubing or conduit.

Figure 5:
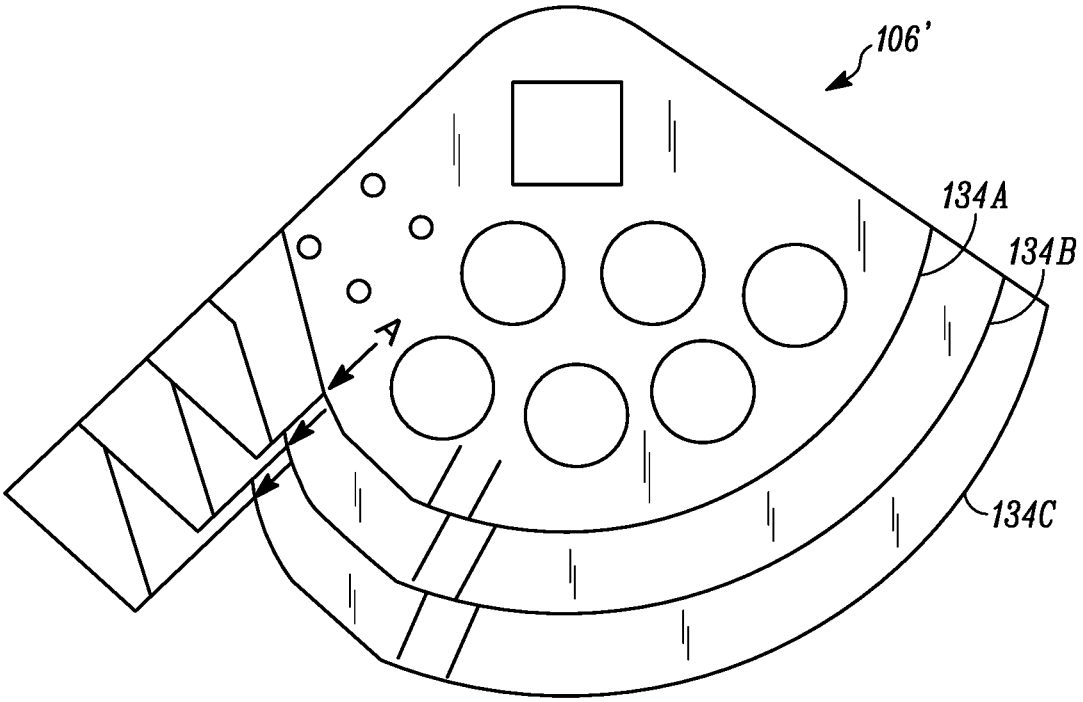
FIG. 5 is a front profile view depicting a combination bender shoe, in accordance with an embodiment of the disclosure.

Referring to FIG. 5, a combination bender shoe 106' is depicted in accordance with an embodiment of the disclosure. The combination bender shoe 106' can define a plurality of arcuate channels 134A-C shaped and sized to receive the cross-sections of conduit of a respective plurality of standard trade sizes. For example, in one embodiment, the combination bender shoe 106' can include a first arcuate channel 134A configured to receive about 3.8 cm (½ inch) EMT, a second arcuate channel 134B configured to receive about 1.9 cm (¾ inch) EMT, and a third arcuate channel 134C configured to receive about 2.5 cm (1 inch) EMT; although other configurations are also contemplated. In some embodiments, the combination bender shoe 106' includes only first and second arcuate channels 134A and 134B. In other embodiments, the combination bender shoe 106' includes a fourth arcuate channel (not depicted) configured to receive about 3.2 cm (1¼ inch) EMT.

The combination bender shoe 106' offers a number of advantages over powered conduit benders of the prior art. Among other things, use of the combination bender shoe 106' enables a user to bend conduit of different sizes without modifying the conduit bender 100, 100', 100". By contrast, U.S. Pat. No. 7,900,495, which discloses a powered conduit bender having a dual bender shoe for bending about 1.2 cm (½ inch) EMT and about 1.9 cm (¾ inch) EMT, and separate bending shoes for bending about 2.5 cm (1 inch) EMT and about 3.2 cm (1¼ inch) EMT, requires a user to reconfigure the conduit bender before bending conduit of a different diameter. With the combination bender shoe 106' no reconfiguration of the conduit bender 100 is required when bending conduit of different diameters, thereby presenting significant time savings. The combination bender shoe 106' also serves to minimize the number of loose parts (i.e., different sized bender shoes) that accompany the conduit bender 100.

Figure 6:
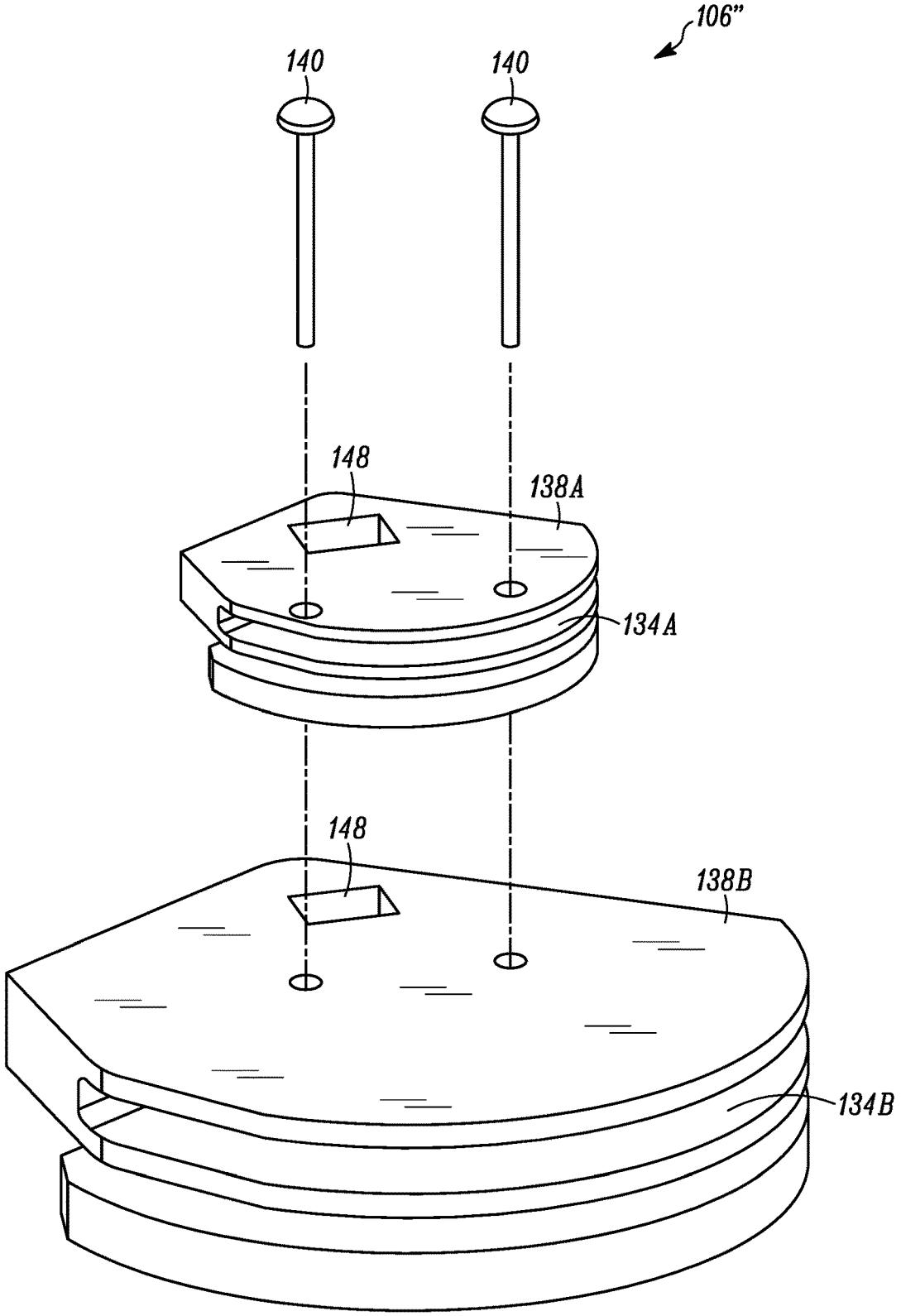
FIG. 6 is a perspective view depicting a stackable combination bender shoe, in accordance with an embodiment of the disclosure.

Referring to FIG. 6, a stackable, combination bender shoe 106" is depicted in accordance with an embodiment of the disclosure. The stackable bender shoe 106" can include two or more plates 138A, 138B having respective arcuate channels 134A, 134B shaped and sized to receive the cross-sections of conduit of different trade sizes. In one embodiment, the two or more plates 138A-B can be selectively coupled to one another via one or more fasteners 140A-B. For example, in one embodiment, a first plate 138A having an arcuate channel 134A configured to receive about 1.2 cm (½ inch) EMT can be coupled to a second plate 138B having an arcuate channel 134A configured to receive about 3.2 cm (1¼ inch) EMT; although other configurations are also contemplated. Accordingly, the stackable bender shoe 106" enables a user to customize a combination bender shoe to meet the needs of a particular job. In particular, with the stackable bender shoe 106", one or more intermediary plates having an arcuate channel configured to receive conduit between the smallest size arcuate channel 134A and the largest size arcuate channel 134B can be eliminated, thereby representing a significant weight savings over a fixed combination bender shoe.

In one embodiment, the bender shoe 106, 106', 106" can be constructed of a lightweight, rigid material, such as aluminum; although other materials, such as high-strength plastics and composites are also contemplated. With continued reference to FIG. 4A, the bender shoe 106 can include a hook 142 configured to engage conduit received within the arcuate channel 134. In one embodiment, the bender shoe 106, 106', 106" can define a plurality of material cutouts 144, for example circular throughbores, configured to reduce the overall weight of the bender shoe 106, 106', 106" by removing material unnecessary for support and function.

In one embodiment, the bender shoe 106, 106', 106" can optionally include markings 146A-C configured to indicate the angular position of the bender shoe 106, 106', 106" relative to other portions of the conduit bender 100, 100', 100" for example the bearing wheel 108 or housing 112. For example, the markings 146A-C can optionally include an arrow (A) to be used with stub, offset and outer marks of saddle bends, a rim notch (N) configured to aid in locating the center of a saddle bend, a star (S) configured to indicate the back of a 90° bend, as well as a degree scale depicting common bending angles relative to another component of the conduit bender 100, 100', 100" (e.g., 10°, 22.5°, 30°, 45°, 60°, etc.) for offset bends and saddles (not depicted).

A connection aperture 148 can be defined in the bender shoe 106 for selective coupling of the bender shoe 106 to the output shaft 132. In one embodiment, the connection aperture 148 can be configured to match a keyed cross-section of the output shaft 132. For example, the output shaft 132 can have a substantially square cross-section; although other shaft configurations, such as circular, semicircular, elliptical, triangular, polygonal, splined, or key cross-sections are also contemplated. In one embodiment, the output shaft 132 can include a quick release mechanism 150 configured to enable ease in connection and disconnection of the bender shoe 106 from the output shaft 132.

Figure 7:
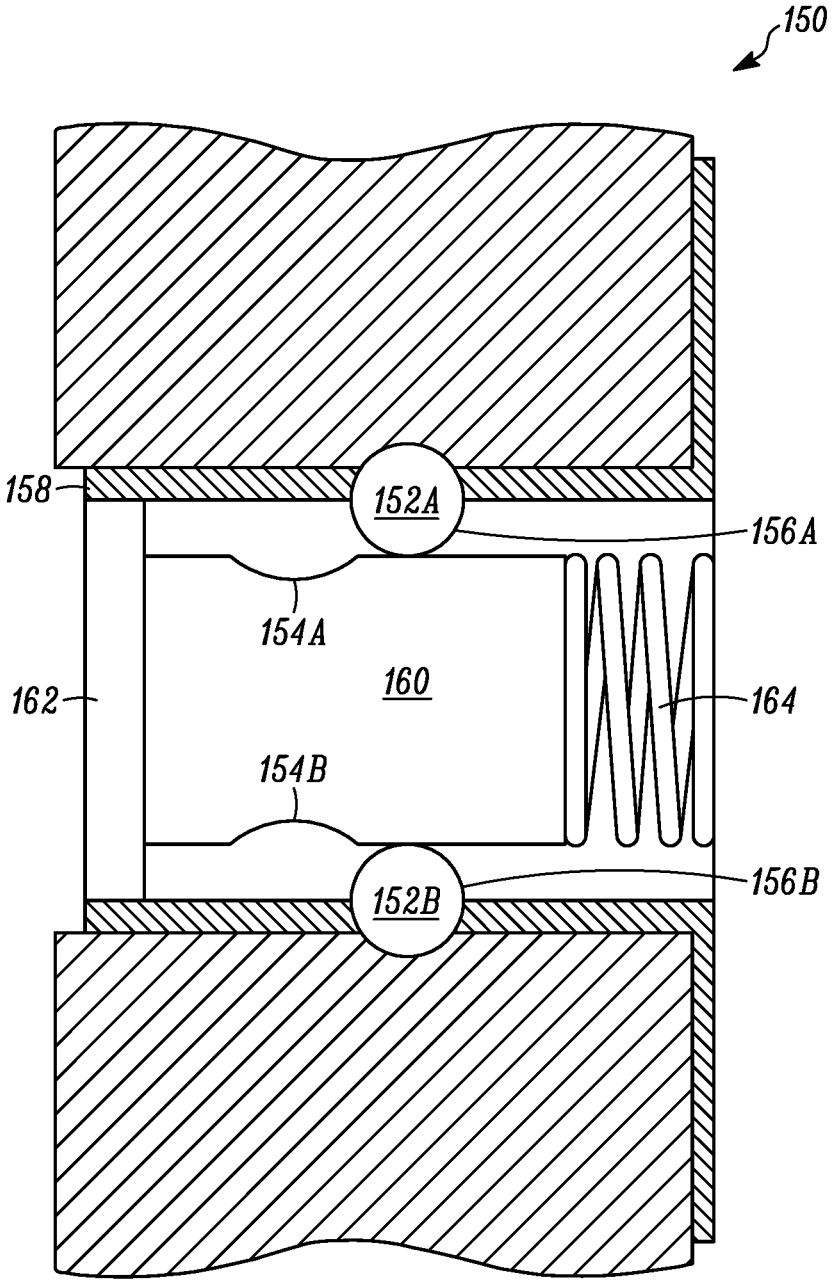
FIG. 7 is a partial cross sectional view depicting a quick release mechanism of a conduit bender, in accordance with an embodiment of the disclosure.

For example, with additional reference to FIG. 7, in one embodiment, the quick release mechanism 150 can include one or more outwardly biased balls 152A/B configured to interface with one or more corresponding detents 154A/B defined within the connection aperture 148. In one embodiment, the one or more balls 152A/B can be forced into one or more corresponding apertures 156A/B defined within a tubular wall 158 of the output shaft 132 into a locked position. The one or more balls 152A/B can be forced into the locked position via a release member 160, which can be shiftable between the locked position (as depicted in FIG. 7) and a release position, for example, by pressing on a release surface 162 of the release member 160. In some embodiments, the release member 160 can be biased to the locked position by a biasing element 164. In the release position, one or more detents 154A/B defined by the release member 160 can be positioned in proximity to the one or more balls 152A/B, thereby enabling the one or more balls 152 to shift inwardly into the one or more detents 154A/B and out of the one or more apertures 156A/B, such that the bender shoe 106 can be positioned over the output shaft 132.

Figure 8:
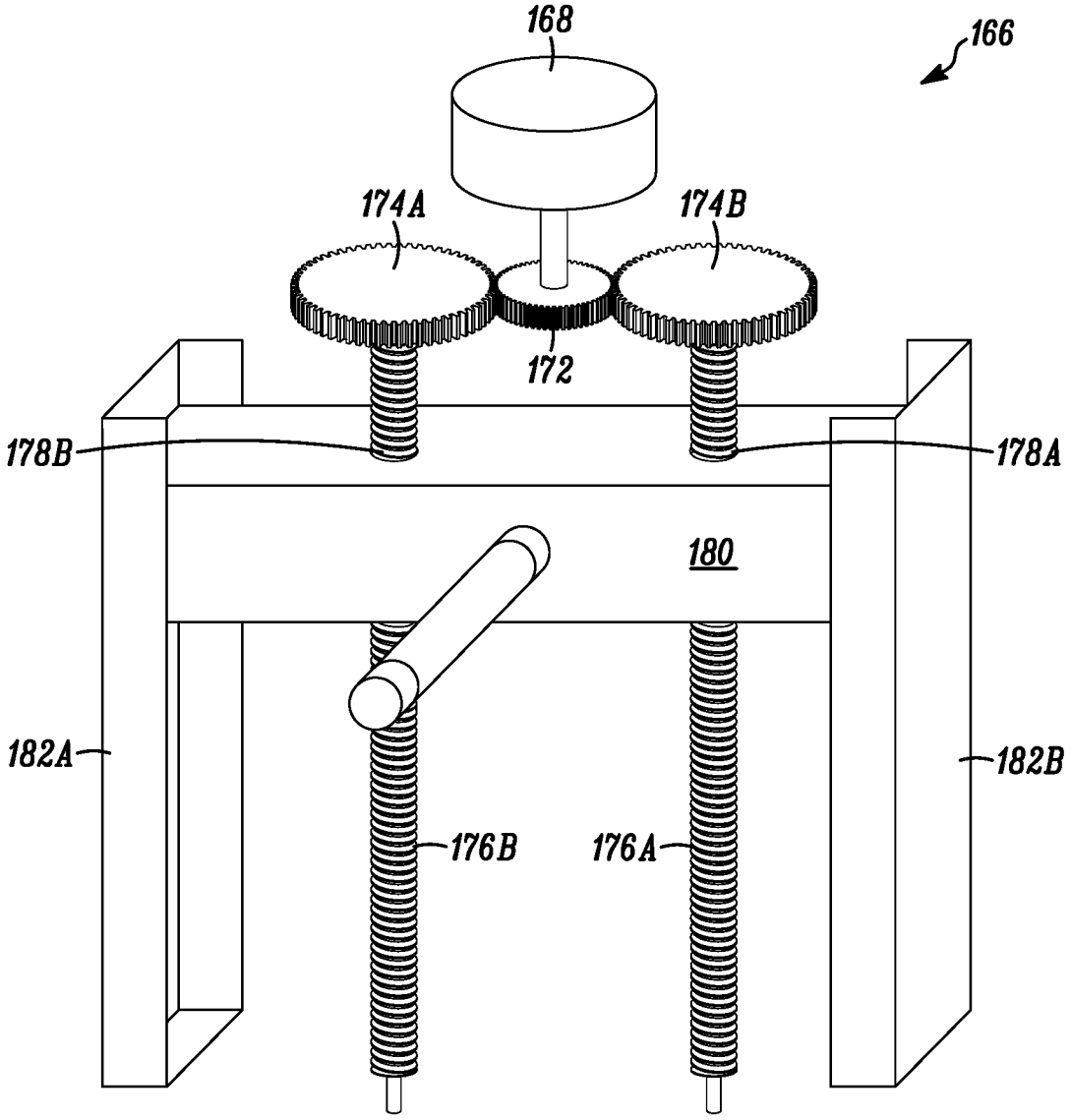
FIG. 8 is a perspective view depicting a bearing wheel assembly, in accordance with an embodiment of the disclosure.

Referring to FIG. 8, an example embodiment of a bearing wheel 108, as a component of a bearing wheel assembly 166, is depicted in accordance with an embodiment of the disclosure. In one embodiment, the bearing wheel assembly 166 can optionally include a mechanism for adjusting a distance of the bearing wheel 108 from the output shaft 132 or bender shoe 106. For example, in some embodiments, a position of the bearing wheel 108 relative to the frame 110 or housing 112 can be adjusted by a driver 168, such as an electric motor or manual adjustment knob 170 (as depicted in FIG. 2C). In one embodiment, the driver 168 can be coupled to a first gear 172, such that the driver 168 and the first gear 172 are configured to rotate at the same speed. The first gear 172 can be configured to interface with one or more second gears 174A/B, which in turn can be coupled to one or more corresponding threaded rods 176A/B. The threaded rods 176A/B can traverse through corresponding threaded bores 178A/B of a sliding member 180 to which the bearing wheel 108 can be rotationally coupled. In one embodiment, the sliding member 180 can be configured to slide along at least one rail 182A/B, which can be defined by a portion of the frame 110 or housing 112. Various gearing ratios between the first gear 172 and the one or more second gears 174A/B have been contemplated to obtain a desired bearing wheel 108 adjustment actuation speed. Accordingly, in one embodiment, the bearing wheel 108 can be driven or otherwise moved to a desired distance from the output shaft 132 or bender shoe 106 during bending operations to guide and support conduit during bending operations and to accommodate conduit of varying sizes.

The bearing wheel 108 can have a substantially circular cross-section defining a concave groove shaped and sized to enable a portion of conduit to reside therein and pass therethrough (as depicted in FIG. 2E). Where a combination bender shoe 106', 106" (such as that depicted in FIGS. 5 and 6) is utilized, the bearing wheel 108 can include a plurality of concave grooves shaped and sized to enable conduit of a plurality of sizes to reside therein and pass therethrough. Other embodiments of the bearing wheel 108 can have an ungrooved surface (as depicted in FIG. 2D), so as to not limit use of the bearing wheel 178 to any particular conduit diameter or size.

In one embodiment, the frame 110 or housing 112 can include one or more bearing wheel markings 184A-C (as depicted in FIG. 2A) configured to aid a user in determining the location of the bearing wheel 108 relative to the output shaft 132. For example, the bearing wheel markings 184A-C can include ideal positional indications of the bearing wheel 108 for receipt of about 1.2 cm (½ inch) EMT, 1.9 cm (¾ inch) EMT, and 2.5 cm (1 inch) EMT; although other positional markings are also contemplated. In some embodiments, an arrow 186 or other alignment indicator can be configured to align with the bearing wheel markings 184 upon proper alignment of the bearing wheel 108.

In some embodiments, the conduit bender 100, 100', 100" can include a leveling device 188 (as depicted in FIG. 2D), configured to serve as an aid in leveling the conduit bender 100, 100', 100" relative to a gravitational frame of reference along at least one of an x-axis and y-axis. For example, in one embodiment, the leveling device 188 can be a bubble level, such as a bull's-eye bubble level, or some other type of leveling tool, such as a magnetic level. In some embodiments, the leveling device 188 can be included within a display 190/keypad 192, which in some embodiments can be incorporated into a component of the conduit bender 100, 100', 100", such as the housing 112.

Figure 9:
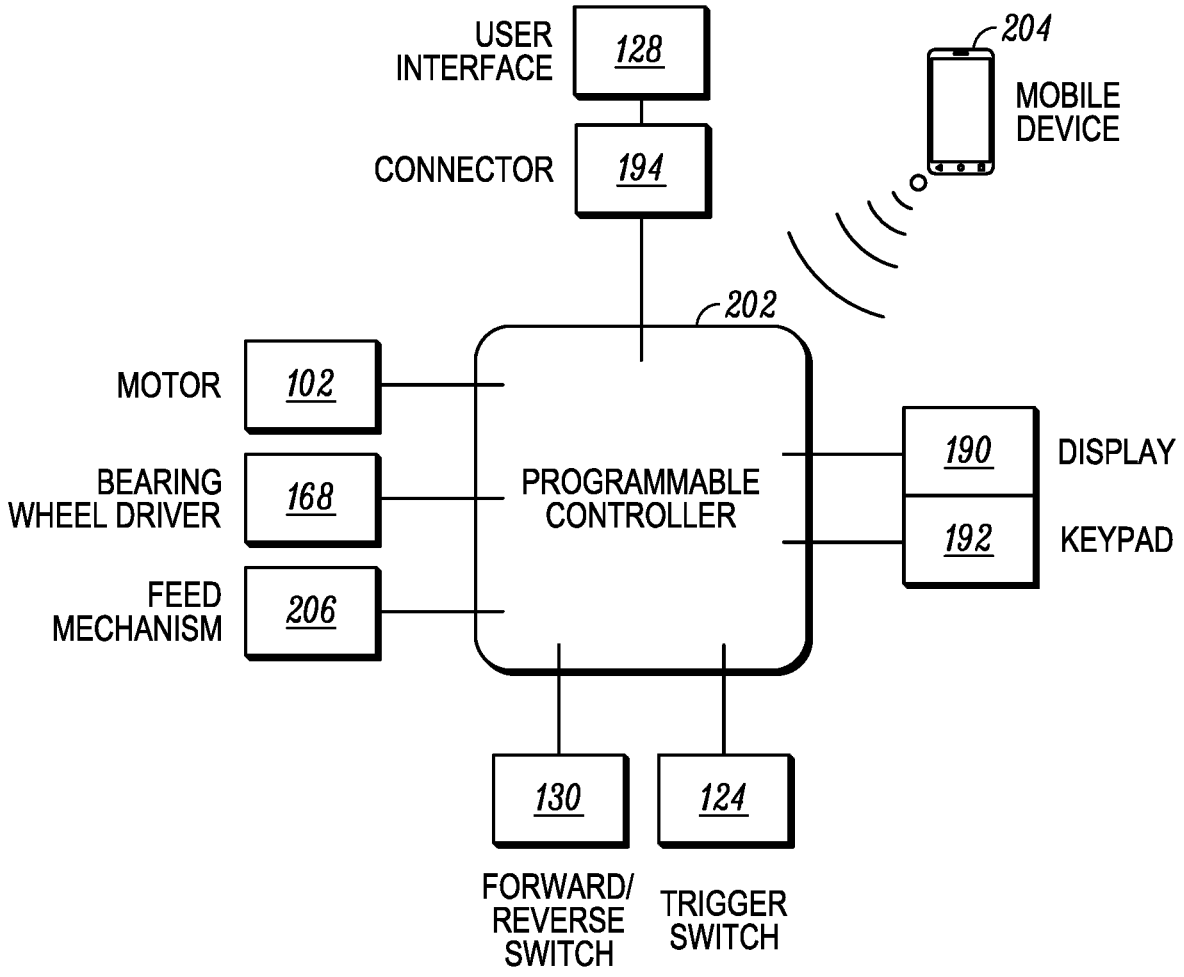
FIG. 9 is a schematic view depicting a programmable controller for a conduit bender, in accordance with an embodiment of the disclosure.

As further depicted in FIG. 2E, the conduit bender 100' can optionally be coupled to a remote user interface 128 (e.g., a foot switch). In some embodiments, the housing 112 can define one or more electrical connectors 194 (as depicted in FIGS. 2C and 3B) configured to enable coupling of a user interface 128 (as depicted in FIG. 2E) or mobile computing device (e.g., a cellular phone or tablet, as depicted in FIG. 9 to the conduit bender 100, 100', 100". In other embodiments, one or more external or remote user interfaces 128 can communicate with the conduit bender 100, 100', 100" via a wireless connection. In one embodiment, the conduit bender 100, 100', 100" can include a work light 196 (as depicted in FIG. 2D) configured to illuminate a portion of the conduit in proximity to the bending shoe 106 and bearing wheel 108.

In one embodiment, the conduit bender 100, 100', 100" can have angular position sensing capabilities of the rotating components relative to stationary components. In these embodiments, the conduit bender 100, 100', 100" can include an angular position sensor 198 (as depicted in FIGS. 2B and 3B) configured to sense rotation of at least one of the driven shaft 122, components of the reductive gear set 104, output shaft 132, or bender shoe 106, relative to the frame 110 or housing 112. For example, in one embodiment, the angular position sensor 198 can be operably coupled to the driver 102 or output shaft 122 to provide information regarding the angular position of the rotating components relative to the stationary components.

In some embodiments, the conduit bender 100, 100', 100" can be configured to display an angular position of rotating components (e.g., the bender shoe 106) relative to stationary components (e.g., the frame 110 or housing 112) via the display 190. In some embodiments, the driver 102 can be smart (e.g., programmable), such that a user can input a desired angular position of the bender shoe 106 into the keypad 192 or other user interface (e.g., a smartphone or other mobile computing device) coupled to a programmable controller 202 (as depicted in FIG. 9), prior to actuating the driver 102 (e.g., via trigger 124 or remote user interface 128). For example, in one embodiment, a user can utilize a mobile computing device 204, such as a cellular phone or tablet, in a wired or wireless connection with the programmable controller 202 to transmit information to and receive information from the programmable controller 202.

Figure 10:
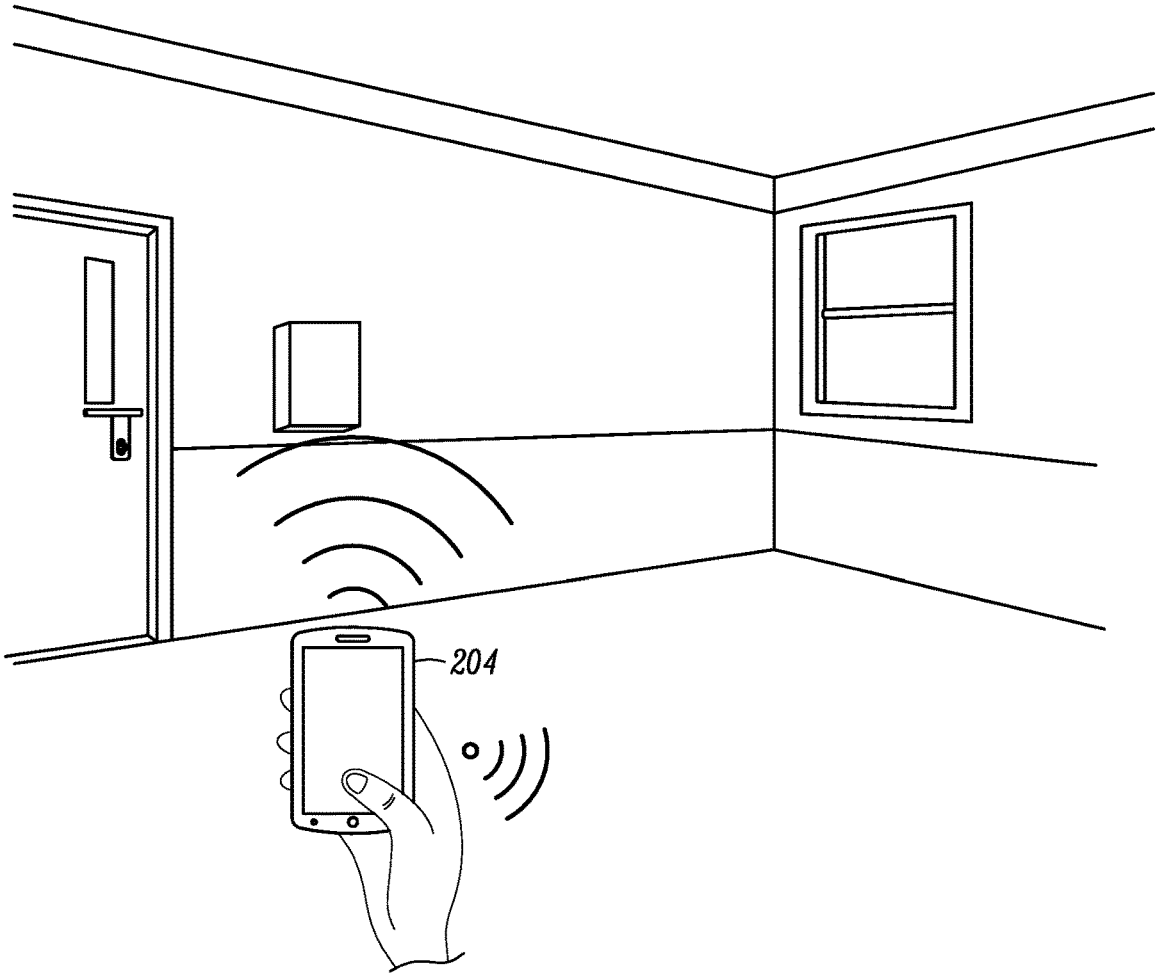
FIG. 10 is a schematic view depicting a mobile computing device serving as an aid in determining one or more dimensions of a space in which conduit is to be installed, in accordance with an embodiment of the disclosure.

With reference to FIG. 10, in one embodiment, a user can utilize a mobile computing device 204 as an aid in determining one or more dimensions of a space in which conduit is to be installed. For example, in one embodiment, the mobile computing device 204 can be positioned against fixed surfaces within the space, thereby enabling the mobile computing device 204 to record respective positions of each surface in order to develop a three-dimensional model of the space in which conduit is to be installed. In another embodiment, the mobile computing device 204 can have scanning capabilities configured to detect fixed surfaces within the space to develop a three-dimensional model. For example, in one embodiment, the mobile computing device 204 can utilize a laser, camera, or other optical sensor to detect fixed surfaces within the space. Thereafter, a user or the mobile computing device 204 can determine a desired layout of conduit within the space and a set of conduit bend specifications. The set of conduit bend specifications can include the number and angle of each of the bends required in the various sections or portions of conduit necessary to complete the desired layout. In one embodiment, the mobile computing device 204 or display 190/keypad 192 can include a smart bend angle calculator configured to determine a multiplier to determine bend spacing, bend angles, and bends in multiple planes where one bend is rotated along a longitudinal axis of the conduit with respect to a prior or subsequent bend.

In some embodiments, the conduit bender 100, 100', 100" can further be configured to automatically feed a section of conduit through the conduit bender 100, 100', 100" to complete the number and angle of each of the bends required of the section. For example, with reference to FIG. 3B, in one embodiment, the conduit bender 100" can include an automatic feed mechanism 206 configured to enable a section of conduit to be advanced, retracted and rotated about its longitudinal axis relative to the bender shoe 106. As depicted, the automatic feed mechanism 206 can include one or more feed rollers 208 and one or more rotational rollers 210, which can be activated to selectively advance, retract and rotate a section of conduit during bending operations. In some embodiments, the one or more feed rollers 208 and the one or more rotational rollers 210 can respectively include sensors 212 and 214 configured to monitor movement (e.g., advancement, retraction and rotation) of the conduit. Accordingly, in some embodiments, a user can utilize the conduit bender 100, 100', 100" to automatically bend a portion of conduit with all of the necessary bends at the appropriate angles to complete a desired layout of conduit within a given space.

In some embodiments, the automatic feed mechanism 206 can include at least a first portion 216A and a second portion 216B configured to move relative to one another to accommodate conduit of varying sizes. For example, in one embodiment, at least one of the first portion 216A and the second portion 216B can include a drive assembly 218A/B configured to shift the respective first portion 216A and second portion 216B relative to the housing 112. For example, in one embodiment, the one or more respective drive assemblies 218A/B can be similar to the bearing wheel assembly 166 depicted in FIG. 8.

Figure 11:
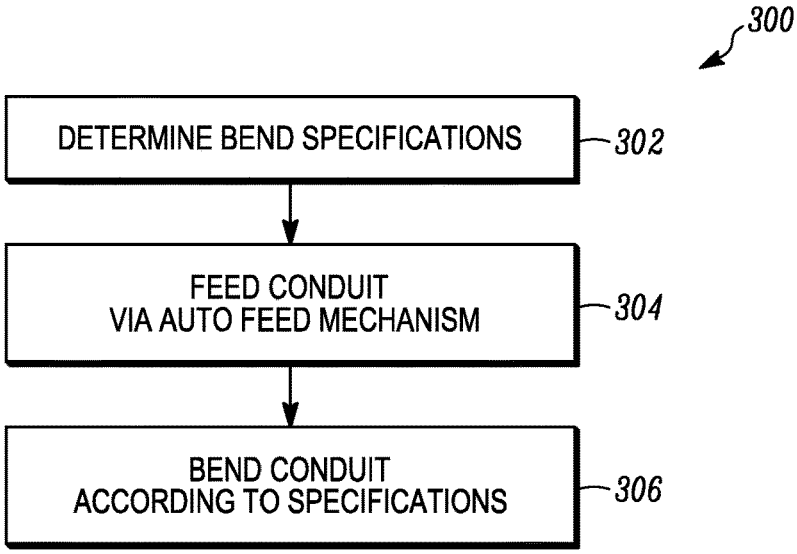
FIG. 11 is a flowchart depicting a method of automatically bending a portion of conduit, in accordance with an embodiment of the disclosure.

With reference to FIG. 11, a method 300 of automatically bending a section of conduit with conduit bender 100, 100', 100" is depicted in accordance with an embodiment of the disclosure. At 302, the bend specifications (e.g., the desired number, angle and spacing between bends) can be determined for a section of conduit. As previously described, in some embodiments a mobile computing device 204, display 190, or keypad 192 can be utilized to determine the bend specifications. In some embodiments, the mobile computing device 204 or display 190 can be configured to display a virtual section of conduit (or multiple sections of conduit forming a desired layout within a given space) for viewing before actual bending operations take place. Further, in some embodiments, a user can manipulate the bend specifications of each section of conduit within the virtual display for further customization of the desired layout.

At 304, a section of conduit can be fed into the automatic feed mechanism 206 of the conduit bender 100, 100', 100", which in some embodiments can initiate automatic bending operations. Thereafter, at 306, the conduit bender 100, 100', 100" can advance the section of conduit via the automatic feed mechanism 206 into contact with the bender shoe 106 to complete the desired number of bends in the section of conduit according to the bend specifications, wherein after each bend, the automatic feed mechanism 206 can continue to advance and rotate the section of conduit as necessary to complete additional bends according to the bend specifications.

It should be understood that the individual steps used in the methods of the present teachings may be performed in any order and/or simultaneously, as long as the teaching remains operable. Furthermore, it should be understood that the apparatus and methods of the present teachings can include any number, or all, of the described embodiments, as long as the teaching remains operable.

Accordingly, with continued reference to FIG. 9, in one embodiment, the programmable controller 202 can be configured to receive pending bend specifications from at least one of the mobile computing device 204, display 190 or keypad 192 to adjust the feed mechanism 206 and the bearing wheel driver 168 from initial positions to a desired positions in relation to a section of conduit (e.g., such that the one or more feed rollers 208, one or more rotational rollers 210, and bearing wheel 108 contact the section of conduit). Thereafter, the programmable controller 202 can instruct the feed mechanism 206 to advance and rotate the section of conduit relative to the bender shoe 106, and activate the driver 102 to complete each of the desired bends within the section of conduit to the desired bend angle.

Upon the completion of each bend, the programmable controller 202 can be configured to instruct the feed mechanism 206 to advance and rotate the section of conduit as necessary to position the section of conduit relative to the bender shoe 106 for any additional bends. Periodically, a distance of the bearing wheel 108 relative to the bender shoe 106 may be adjusted or the bender shoe 106 may be driven in reverse to promote ease in advancing the section of conduit through the conduit bender 100, 100', 100". Upon completion, the programmable controller 202 can be configured to drive the bender shoe 106, bearing wheel 108 and feed mechanism 206 back to its respective initial position for release of the section of conduit.

Figure 12A:
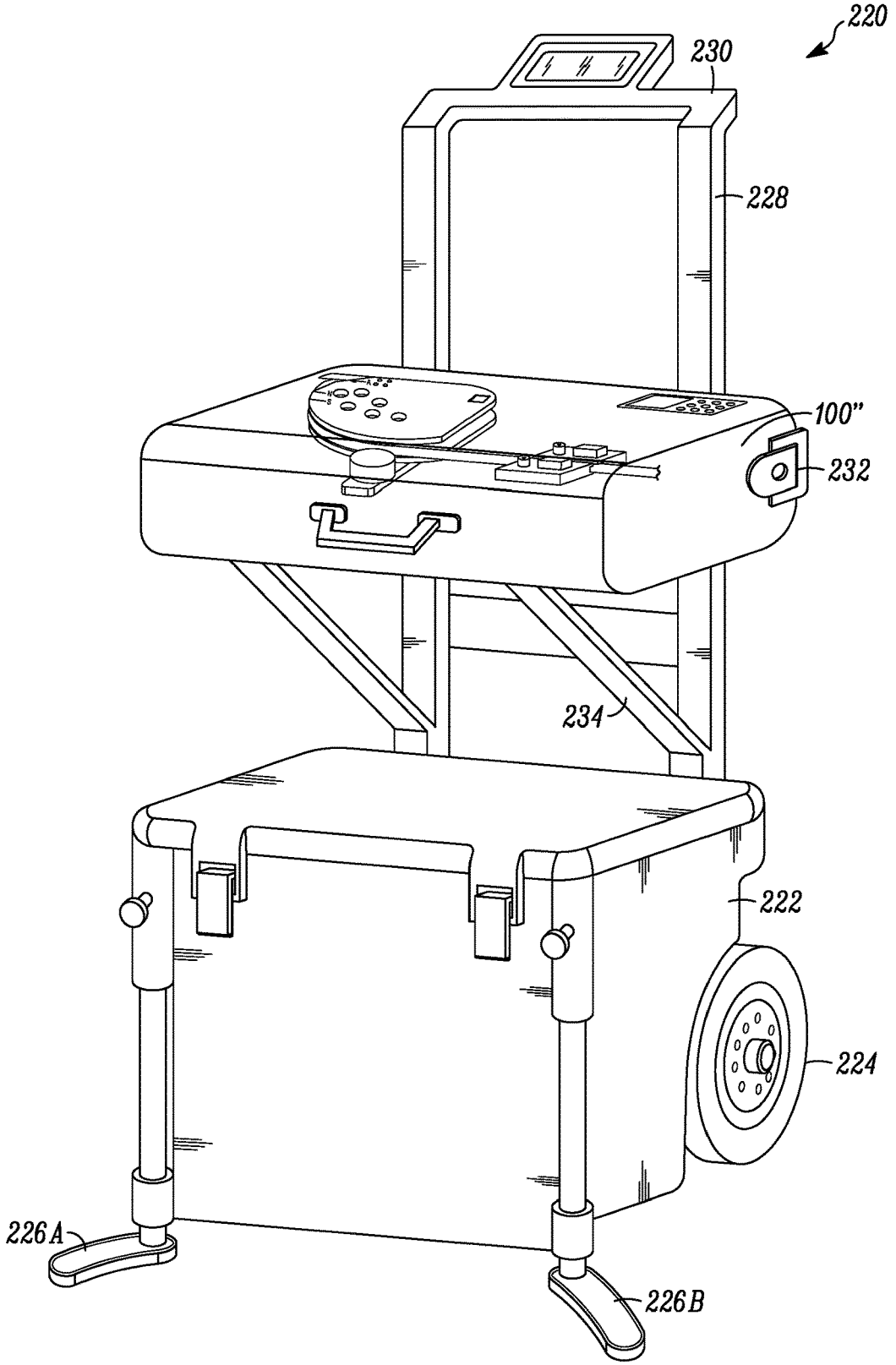
FIG. 12A is a perspective view depicting a conduit bender operably coupled to a wheeled cart, with the conduit bender positioned in a generally horizontal configuration, in accordance with an embodiment of the disclosure.
Figure 12B:
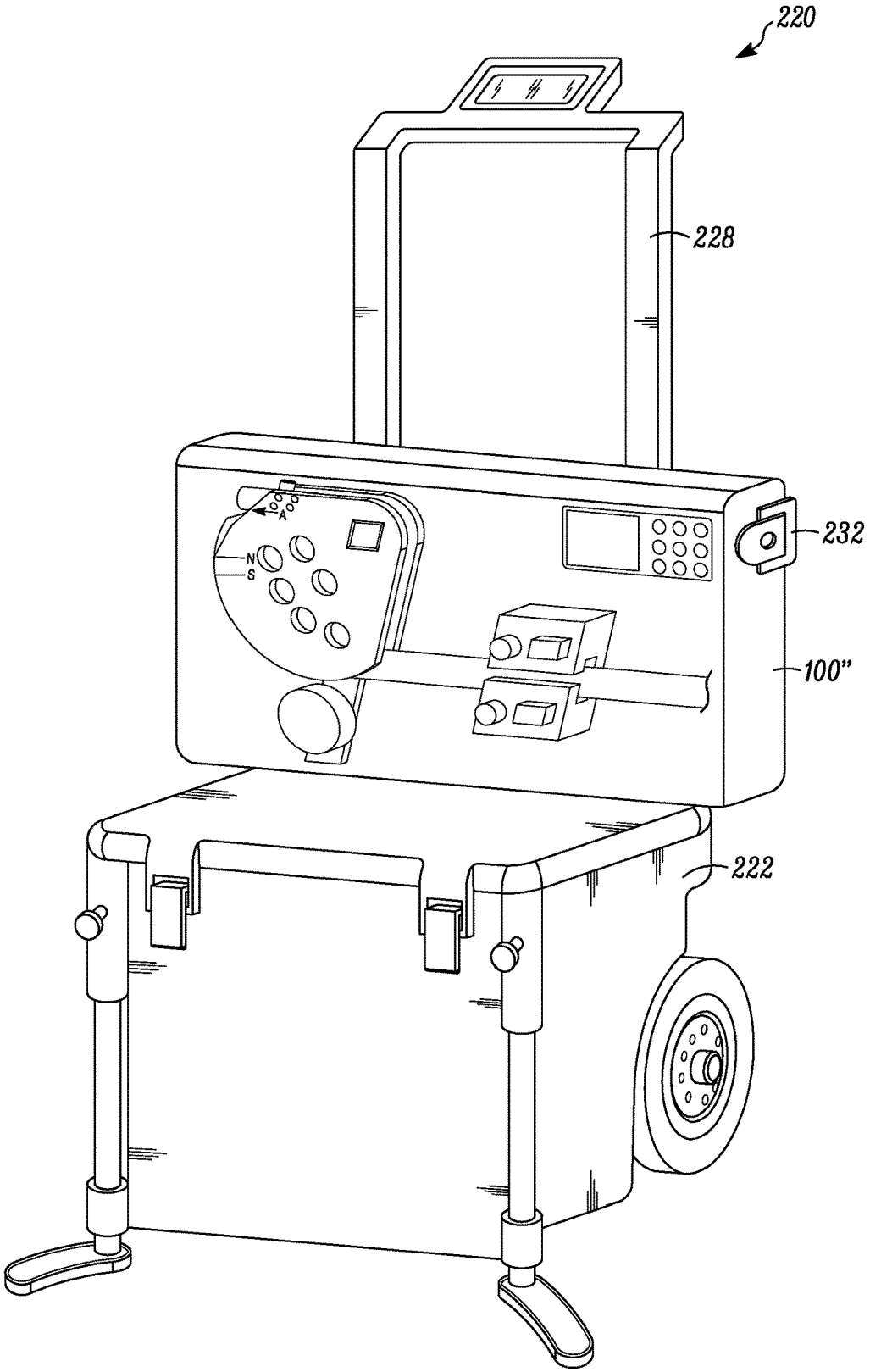
FIG. 12B is a perspective view of the conduit bender of FIG. 12A, with the conduit bender positioned in a generally vertical configuration.

With reference to FIGS. 12A-B, in one embodiment, the conduit bender 100, 100', 100" can be operably coupled to a wheeled cart 220 or dolly for ease in transportation and use. As depicted, in one embodiment, the cart 220 can include a base 222 including one or more wheels 224 and one or more optional feet 226. In one embodiment, the one or more feet 226 can be configured to selectively extend downwardly with respect to a gravitational frame of reference and rotate relative to the base 222 to improve stability of the cart 220 during bending operations. In some embodiments, the base 222 can be formed as a selectively sealable compartment configured to store items, such as additional bender shoes 106.

An upright portion 228 can extend substantially upwardly from the base 222. The upright portion 228 can include a handle 230 for manipulation of the cart 220. In some embodiments, the handle 230 can include a recess, pocket, or other compartment configured to support a mobile device 204 (depicted in FIG. 9). The conduit bender 100, 100', 100" can be mounted to the upright portion 228, for example via a pivotable bracket 232, thereby enabling the conduit bender 100, 100', 100" to pivot between a substantially horizontal position (as depicted in FIG. 12A) and a substantially vertical position (as depicted in FIG. 12B) relative to the upright portion 228. In one embodiment, one or more struts 234 can be utilized to support the conduit bender 100, 100', 100" relative to the upright portion 228 in the substantially horizontal position. Accordingly, the conduit bender 100, 100', 100" can be selectively positioned between the substantially horizontal position and the substantially vertical position to meet the needs of the user, which may be advantageous during certain bending operations or during transportation.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

What is claimed is:

1. A portable bending tool, comprising:

a housing operably coupled to a base defining one or more ground engaging feet, the housing defining an interior cavity;

an electric motor;

a removable, rechargeable battery pack;

a reductive gear set at least partially positioned within the interior cavity of the housing, the reductive gear set configured to reduce a rotational output of the electric motor between an input shaft and an output shaft, wherein the output shaft extends to an exterior of the housing in a substantially vertical orientation with respect to a gravitational frame of reference when the portable bending tool is resting on the one or more ground engaging feet;

a bending form operably coupled to the output shaft of the reductive gear set, the bending form is configured to be driven by the output shaft to rotate the bending form relative to the housing along a plane oriented substantially horizontally with respect to a gravitational frame of reference when the portable bending tool is resting on the one or more ground engaging feet, the bending form defining an arcuate channel shaped and sized to receive a cross-section of tubing; and a tube guide member operably coupled to the housing to guide and support tubing during a bending operation, wherein the tube guide member is movable to a desired distance from the output shaft while maintaining contact with the housing.

2. The portable bending tool of claim 1, further comprising a programmable controller to automatically drive the electric motor according to one or more user defined bend specifications, wherein the programmable controller drives one or more of an actuation, speed, duration, or directional control of the electric motor.

3. The portable bending tool of claim 2, further comprising a sensor to sense an angular position between one or more rotatable components relative to one or more stationary components to infer a bend angle affected in the tubing.

4. The portable bending tool of claim 3, wherein the programmable controller receives data from the sensor to automatically drive the electric motor according to one or more user defined bend specifications.

5. The bending system of claim 3, further comprising a remote user interface in wireless communication with the programmable controller, wherein the remote user interface enables a user to at least one of transmit information to or receive information from the programmable controller.

6. The portable bending tool of claim 5, wherein the remote user interface is presented on at least one of a cellular telephone, tablet or portable computer.

7. The portable bending tool of claim 5, wherein the remote user interface is configured to receive at least one user defined bend specification.

8. The portable bending tool of claim 5, wherein the remote user interface includes a bend angle calculator configured to aid a user in determining at least one of bend spacing, bend angles, and bends in multiple planes where one bend is rotated along a longitudinal axis of the tubing with respect to a prior or subsequent bend.

9. The portable bending tool of claim 1, wherein automatic drive of the electric motor is initiated via user interaction with a trigger mounted on a handgrip of the bending tool.

10. A portable bending tool, comprising:

a housing selectively positionable on a horizontally oriented work surface;

a driver;

a removable, rechargeable battery pack;

a reductive gear set at least partially positioned within an interior cavity of the housing, the reductive gear set configured to reduce a rotational output of the driver between an input shaft and an output shaft, wherein the output shaft extends to an exterior of the housing substantially orthogonal to the work surface;

a bending form operably coupled to the output shaft of the reductive gear set, the bending form configured to be driven by the output shaft to rotate the bending form relative to the housing along a plane extending substantially parallel to the work surface, the bending form defining an arcuate channel shaped and sized to receive a cross-section of tubing;

a tube guide member operably coupled to the housing to guide and support tubing during a bending operation, wherein the tube guide member is movable to a desired distance from the output shaft while maintaining contact with the housing; and a sensor to sense an angular position between one or more rotatable components relative to one or more stationary components to infer a bend angle affected in the tubing.

11. The portable bending tool of claim 10, further comprising a display displaying data from the sensor.

12. The portable bending tool of claim 10, further comprising a programmable controller to receive data from the sensor to automatically drive the driver according to one or more user defined bend specifications, wherein the programmable controller receives input regarding one or more user defined bend specifications.

13. The portable bending tool of claim 12, further comprising a user interface to at least one of transmit information to or receive information from the programmable controller.

14. The portable bending tool of claim 13, wherein the user interface is configured to aid a user in determining at least one of bend spacing, bend angles, and bends in multiple planes where one bend is rotated along a longitudinal axis of the tubing with respect to a prior or subsequent bend.

15. The portable bending tool of claim 12, wherein the one or more user defined bend specifications comprise at least an angle of a desired bend in the tubing.

16. The portable bending tool of claim 12, wherein the programmable controller is in wireless communication with a mobile computing device.

17. The portable bending tool of claim 10, wherein automatic drive of the driver is initiated via user interaction with a trigger mounted on a handgrip of the bending tool.

18. The portable bending tool of claim 10, wherein the driver is powered by the removable, rechargeable battery pack.

19. A portable bending tool, comprising:

a housing;

a driver;

a removable, rechargeable battery pack;

a reductive gear set at least partially positioned within an interior cavity of the housing, the reductive gear set configured to reduce a rotational output of the driver between an input shaft and an output shaft, wherein the output shaft extends to an exterior of the housing in a substantially vertical orientation with respect to a gravitational frame during bending operations;

a bending form operably coupled to the output shaft of the reductive gear set, the bending form configured to be driven by the output shaft to rotate the bending form relative to the housing along a plane oriented substantially orthogonal to the output shaft, the bending form defining an arcuate channel shaped and sized to receive a cross-section of tubing;

a tube guide member operably coupled to the housing to guide and support tubing during a bending operation, wherein the tube guide member is movable to a desired distance from the output shaft while maintaining contact with the housing.

20. The portable tool of claim 19, further comprising a programmable controller to automatically drive the driver according to one or more user defined bend specifications, wherein the programmable controller receives input regarding one or more user defined bend specifications.

21. The portable tool of claim 20, further comprising a user interface to at least one of transmit information to or receive information from the programmable controller, wherein the user interface is configured to aid a user in determining at least one of bend spacing, bend angles, and bends in multiple planes where one bend is rotated along a longitudinal axis of the tubing with respect to a prior or subsequent bend.

* * * * *